United States Patent [19]

Syms

[11] Patent Number: 5,076,444

[45] Date of Patent: Dec. 31, 1991

[54] CRAYON HOUSING APPARATUS

[76] Inventor: William B. Syms, 810 East Ave., N. Augusta, S.C. 29841

[21] Appl. No.: 682,302

[22] Filed: Apr. 9, 1991

[51] Int. Cl.[5] ..... A47F 5/00

[52] U.S. Cl. ..... 211/69.5; 211/163; 211/70

[58] Field of Search ..... 211/70, 69.5, 69.1, 211/60.1, 163; 206/369, 379; 312/79, 97.1

[56] References Cited

U.S. PATENT DOCUMENTS

| | | | |
|---|---|---|---|
| 844,431 | 2/1907 | Wehagen | 211/70 X |
| 2,919,796 | 1/1960 | Pressl | 312/97.1 X |
| 3,319,780 | 5/1967 | Russell | 312/97.1 X |
| 3,615,004 | 10/1971 | Wescott | 312/97.1 X |
| 4,505,386 | 3/1985 | Abrahamson | 312/73 X |
| 4,930,953 | 6/1990 | Fischer | 312/73 X |

*Primary Examiner*—Robert W. Gibson, Jr.
*Attorney, Agent, or Firm*—Leon Gilden

[57] ABSTRACT

An apparatus including a base formed with a central hub, with the hub including a cylindrical turn-table member rotatably mounted about the hub, with the turn-table member including a matrix of cylindrical bores directed therethrough, with each cylindrical bore cooperative with an inclined locking sphere cavity rotatably mounting a locking sphere therethrough, wherein absence of a crayon member mounted within a cylindrical receiving socket effects locking of the turn-table relative to the central hub.

4 Claims, 4 Drawing Sheets

18
14
17
16
24
19
23
26
23
12
22
25
14a
20
13a
13
21
11
5
5

CRAYON HOUSING APPARATUS

BACKGROUND OF THE INVENTION

1. Field of the Invention

The field of invention relates to crayon and writing instrument support housings, and more particularly pertains to a new and improved crayon housing apparatus wherein the same is arranged to effect locking of the associated turn-table relative to a support hub in absence of filling of each crayon receiving socket with an associated crayon or cylindrical type writing instrument.

2. Description of the Prior Art

Various housing of various types have been utilized in the prior art to mount crayons or other similar writing instruments therewithin. Such prior art is exemplified in U.S. Pat. Nos. 4,884,701; 4,534,474; 2,500,115; 2,017,088; and 1,221,517.

Prior art apparatus has typically utilized various carrousel or supporting structure to mount writing instruments therewithin, but has previously failed to address the complete replenishment of the various supporting sockets when mounting the writing instruments. The instant invention requires an individual user to replenish a socket to maintain an orderly array of such crayons or writing instruments within each of the sockets to effect selective rotation of the turn-table or carrousel relative to a support base.

Accordingly, it may be appreciated that there continues to be a need for a new and improved crayon housing apparatus as set forth by the instant invention which addresses both the problems of ease of use as well as effectiveness in construction in maintaining alignment and orderly array of writing instruments therewithin and in this respect, the present invention substantially fulfills this need.

SUMMARY OF THE INVENTION

In view of the foregoing disadvantages inherent in the known types of instrument support structure now present in the prior art, the present invention provides a crayon housing apparatus wherein the same maintains alignment and array for ease of use of various writing instruments such as crayons and effects locking of an associated carrousel relative to a base member upon absence of a writing instrument or crayon within an associated receiving socket. As such, the general purpose of the present invention, which will be described subsequently in greater detail, is to provide a new and improved crayon housing apparatus which has all the advantages of the prior art instrument support structure and none of the disadvantages.

To attain this, the present invention provides an apparatus including a base formed with a central hub, with the hub including a cylindrical turn-table member rotatably mounted about the hub, with the turn-table member including a matrix of cylindrical bores directed therethrough, with each cylindrical bore cooperative with an inclined locking sphere cavity rotatably mounting a locking sphere therethrough, wherein absence of a crayon member mounted within a cylindrical receiving socket effects locking of the turn-table relative to the central hub.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved crayon housing apparatus which has all the advantages of the prior art instrument support structures and none of the disadvantages.

It is another object of the present invention to provide a new and improved crayon housing apparatus which may be easily and efficiently manufactured and marketed.

It is a further object of the present invention to provide a new and improved crayon housing apparatus which is of a durable and reliable construction.

An even further object of the present invention is to provide a new and improved crayon housing apparatus which is susceptible of a low cost of manufacture with regard to both materials and labor, and which accordingly is then susceptible of low prices of sale to the consuming public, thereby making such crayon housing apparatus economically available to the buying public.

Still yet another object of the present invention is to provide a new and improved crayon housing apparatus which provides in the apparatuses and methods of the prior art some of the advantages thereof, while simultaneously overcoming some of the disadvantages normally associated therewith.

Still another object of the present invention is to provide a new and improved crayon housing apparatus wherein the same is arranged for maintaining in an orderly array a matrix of crayons therewithin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
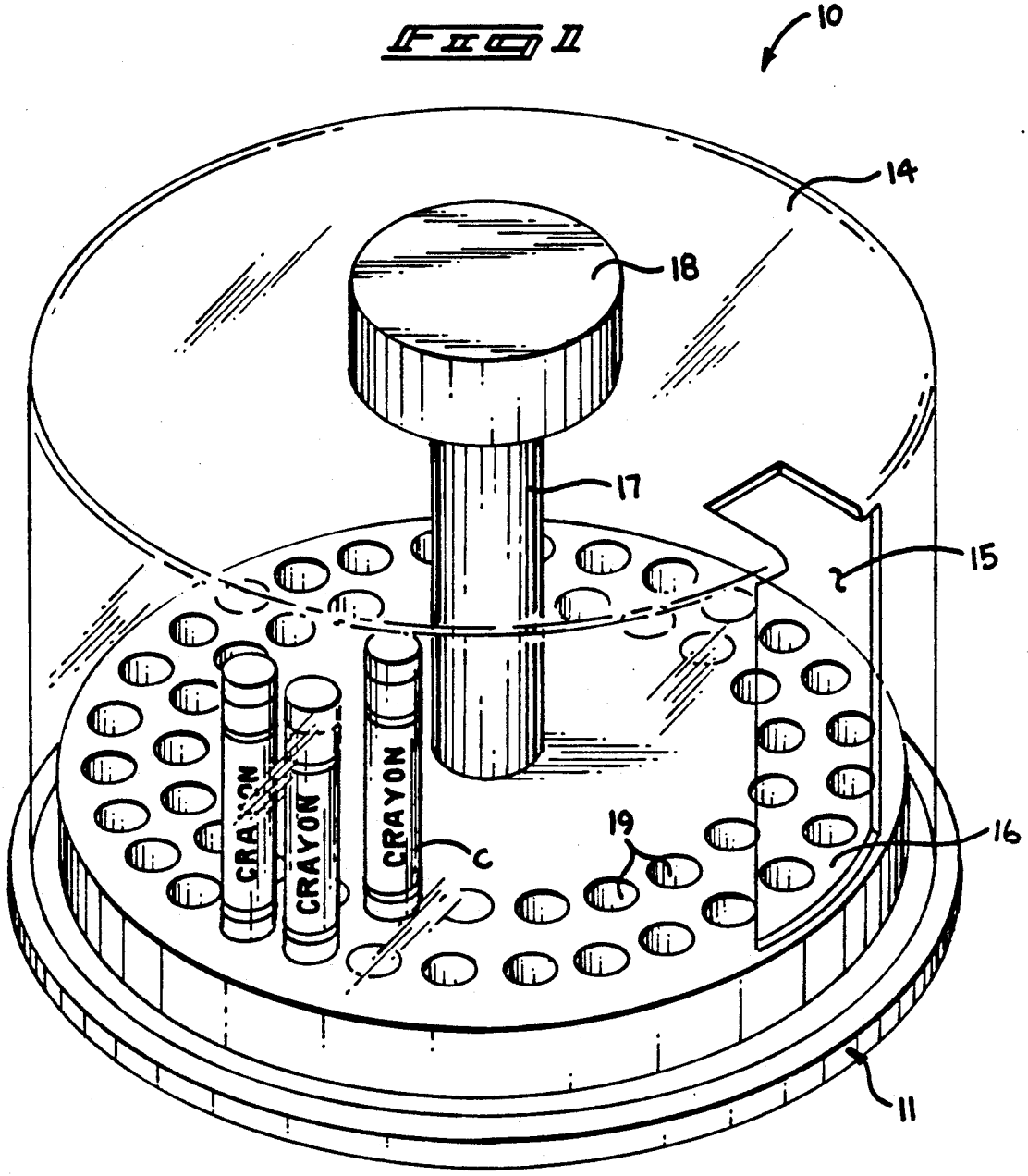
FIG. 1 is an isometric illustration of the instant invention.
Figure 2:
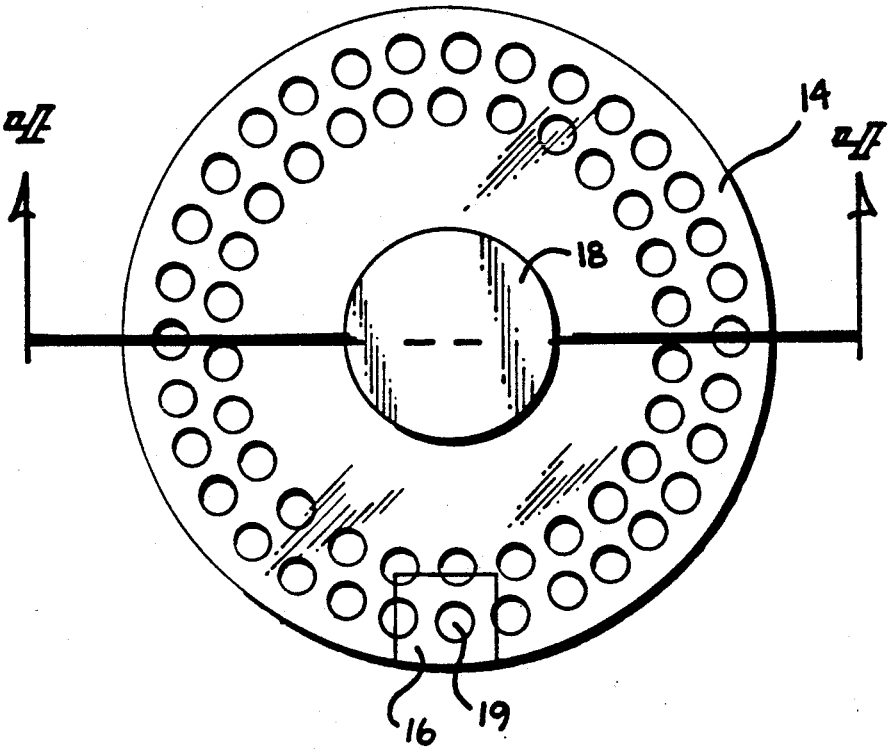
FIG. 2 is an orthographic top view of the instant invention.
Figure 3:
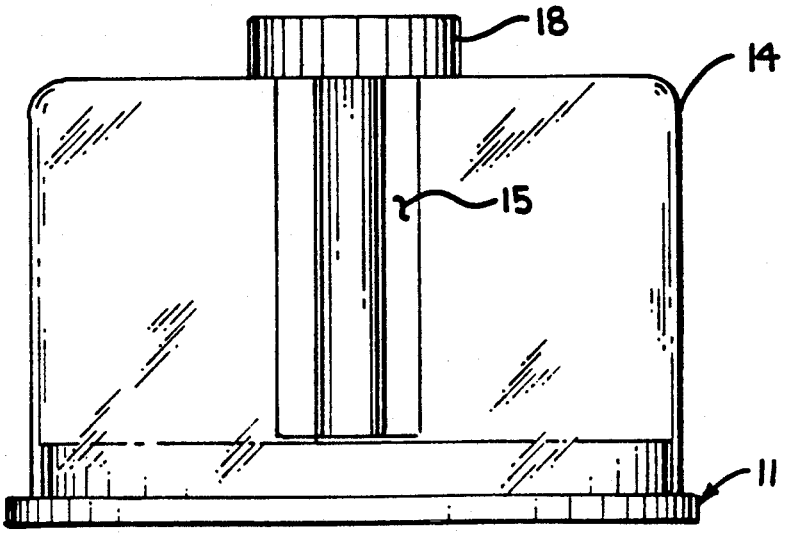
FIG. 3 is an orthographic side view, taken in elevation, of the instant invention.

With reference now to the drawings, and in particular to FIGS. 1 to 5 thereof, a new and improved crayon housing apparatus embodying the principles and concepts of the present invention and generally designated by the reference numeral 10 will be described.

Figure 4:
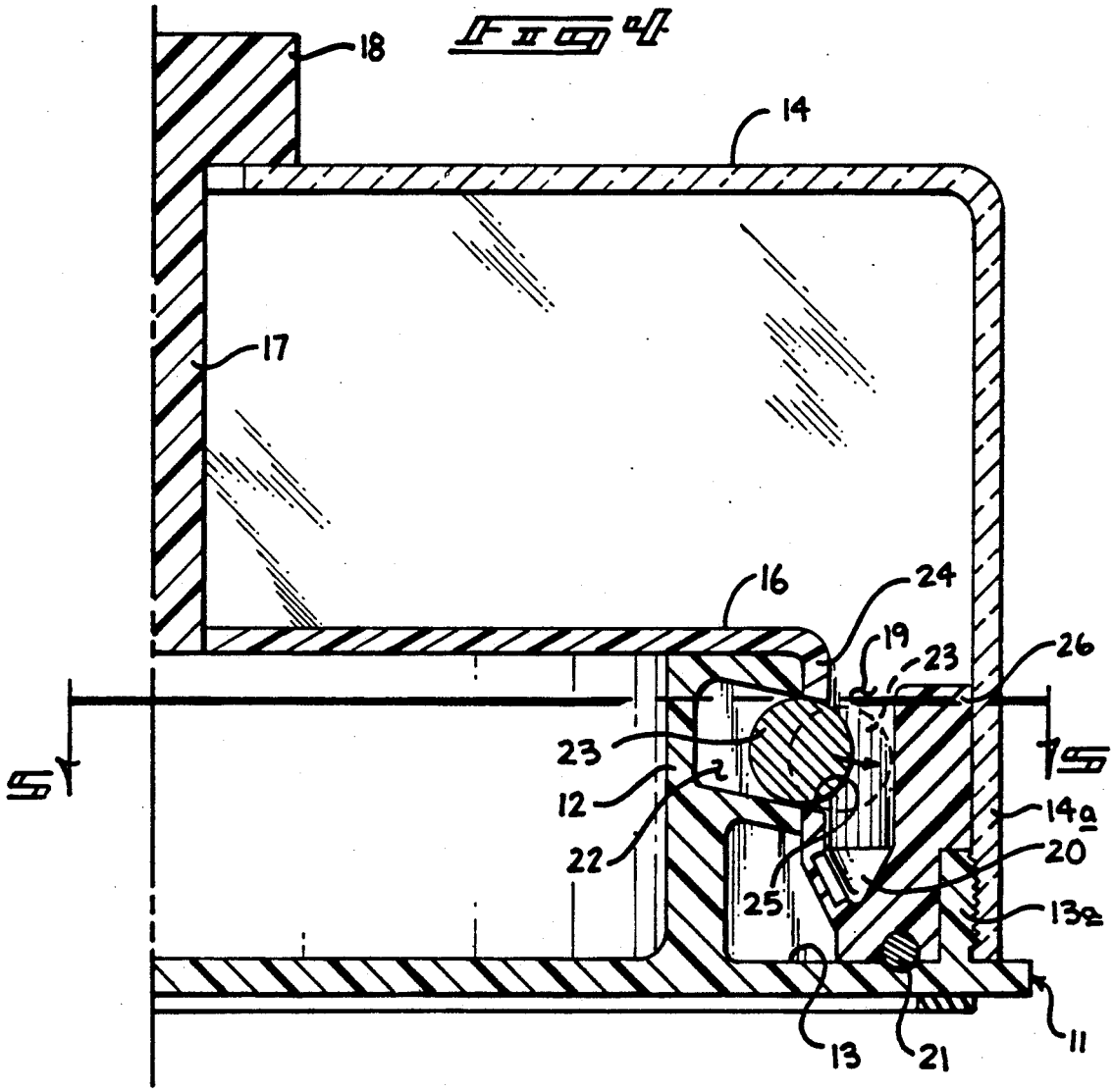
FIG. 4 is an orthographic view, taken along the lines 4—4 of FIG. 3 in the direction indicated by the arrows.
Figure 5:
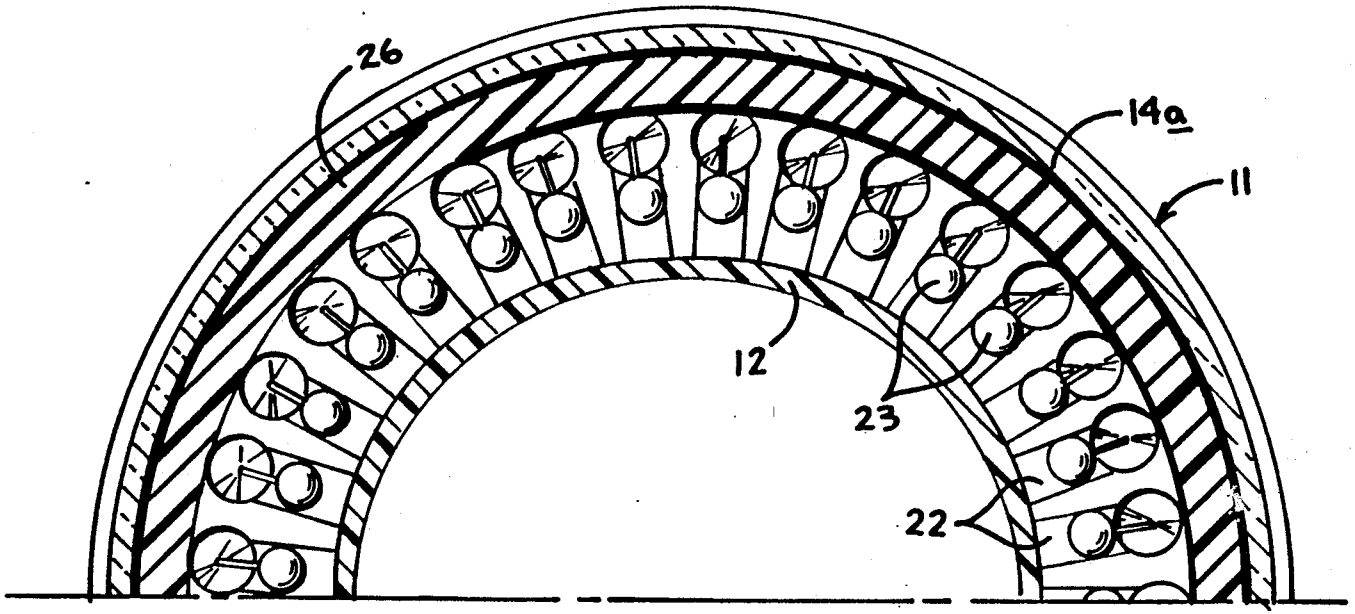
FIG. 5 is an orthographic view, taken along the lines 5—5 of FIG. 4 in the direction indicated by the arrows.

More specifically, the crayon housing apparatus 10 of the instant invention essentially comprises a housing base 11, the housing base 11 is defined by a central coaxially and fixedly mounted central cylindrical base hub 12. The cylindrical base hub 12 is vertically oriented relative to a horizontally oriented housing base plate 13. A transparent cover 14 is provided, formed with a cylindrical side wall 14*a*, formed with a through-extending "L" shaped cover window 15 that is directed through the cylindrical side wall 13*a* and a portion of the horizontal top wall of the transparent cover 14. A cylindrical turn-table member 16 is provided rotatably mounted overlying the central base cylindrical hub 12 and the housing base plate 13. It should be further noted that a lower terminal end of the cylindrical side wall 14*a* is threadedly secured to a base plate externally threaded cylindrical web 13*a* that is coaxially aligned with the central base cylindrical hub 12. Further, the cylindrical turn-table member 16 includes a vertical coaxially oriented handle shaft 17 fixedly mounted medially of the cylindrical turn-table member 16 and projects through a central opening of the transparent cover 14 and projecting exteriorly thereof terminating in a handle 18, whereupon manual grasping of the handle 18 permits relative rotation of the cylindrical turn-table member 16 relative to the housing base 11. A series of ball bearings 21 are captured between a cylindrical exterior vertical web 26 and a top surface of the housing base plate 13. The cylindrical exterior vertical web 26 is positioned contiguous to an interior surface of a cylindrical side wall 14*a*, as illustrated in FIG. 4 for example.

The cylindrical exterior vertical web 26 includes a matrix of cylindrical receiving sockets 19 defined by a first diameter. Each of the sockets 19 includes a conical lower socket end 20. Further, each cylindrical receiving socket 19 communicates with a cylindrical sphere mounting cavity 22 whose axis defines an acute included angle between the axis of the mounting cavity 22 and a horizontal plane defined by the housing base plate 13. Each cylindrical sphere mounting cavity 22 rotatably receives a locking sphere 23 therewithin, wherein the sphere mounting cavity 22 is defined by an axial length greater than a predetermined diameter of each locking sphere 23 defined by a second diameter whose second diameter is greater than the first diameter defined by the cylindrical socket 19. It should be noted that the cylindrical turn-table member 16 includes a turn-table cylindrical interior vertical web diametrically opposed on an opposite side of each cylindrical receiving socket 19 relative to the associated cylindrical exterior vertical web 26, whereupon absence of a crayon member "C" within an associated receiving socket 19 permits rotation of the associated locking sphere 23 downwardly into contact with the receiving socket 19. Inasmuch as the locking sphere 23 diameter is greater than the first diameter of the receiving socket 19, the sphere projects rearwardly into the associated sphere mounting cavity 22 and within the vertical web bore 25 directed into the cylindrical interior vertical web 24 locking the central base cylindrical hub 12 and the cylindrical turn-table member 16 together. Only the presence of a writing instrument or crayon within each of the sockets 19 permits relative rotation of the turn-table member 16 relative to the housing base 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows: .

1. A crayon housing apparatus, comprising a housing base, the housing base including a central cylindrical base hub, the base hub integrally mounted to a housing base plate, the housing base plate including a planar top surface, with the housing base plate formed of a further cylindrical configuration, and a transparent cover fixedly mounted to the housing base plate, and the transparent cover including an "L" shaped cover window, and the transparent cover including a cylindrical side wall and a housing top wall, with the "L" shaped cover window directed through the cylindrical side wall and a portion of the top wall, and a cylindrical turn-table member rotatably mounted between the cylindrical side wall and the central base hub, and a cylindrical turn-table member rotatably mounted relative to the central base hub and the planar top surface, and the turn-table member including a cylindrical exterior vertical web rotatably mounted between an interior surface of the cylindrical side wall and the central base hub, and the cylindrical exterior vertical web including a matrix of cylindrical receiving sockets directed therethrough, with each receiving socket adapted for receiving a writing instrument therewithin, and locking means formed between each of the cylindrical receiving sockets and the central base hub for effecting locking of the cylindrical turn-table member relative to the housing base upon absence of a writing instrument positioned within each socket.

2. An apparatus as set forth in claim 1 including a vertical axially oriented handle shaft fixedly mounted coaxially of the cylindrical turn-table member, with the handle shaft projecting through a central opening in the transparent cover, and a handle member fixedly mounted to an upper terminal end of the handle shaft exteriorly of the transparent cover to effect selective rotation of the cylindrical turn-table member.

3. An apparatus as set forth in claim 2 wherein the locking means includes a cylindrical sphere mounting cavity associated with each socket and directed into the central base hub, with each sphere mounting cavity associated with the respective socket, and the sphere mounting cavity defining a cavity axis defining an acute included angle between the cavity axis and the planar top surface of the housing base plate, and the sphere mounted cavity including a locking sphere rotatably mounted within the sphere mounting cavity, the locking sphere defined by a second diameter, wherein each cylindrical receiving socket is defined by a first diameter, wherein the second diameter is greater than the first diameter, whereupon projection of a locking sphere within an associated cylindrical receiving socket projects the locking sphere into the socket of the cylindrical exterior vertical web and the central base hub to effect locking of the cylindrical turn-table member relative to the central base hub and the housing base.

4. An apparatus as set forth in claim 3 wherein each socket includes a vertical web bore directed through the cylindrical vertical web in cooperation with a respective cylindrical sphere mounting cavity.

* * * * *